US009500991B2

(12) United States Patent
Iida et al.

(10) Patent No.: US 9,500,991 B2
(45) Date of Patent: Nov. 22, 2016

(54) DEVELOPING APPARATUS HAVING SUPPLY DEVICE WITH COMPOUND SPIRAL PORTIONS

(71) Applicant: CANON KABUSHIKI KAISHA, Tokyo (JP)

(72) Inventors: Takanori Iida, Noda (JP); Yusuke Ishida, Toride (JP); Hisashi Tsukijima, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/307,799

(22) Filed: Jun. 18, 2014

(65) Prior Publication Data

US 2015/0003876 A1 Jan. 1, 2015

(30) Foreign Application Priority Data

Jun. 28, 2013 (JP) ..... 2013-136150

(51) Int. Cl.
*G03G 15/08* (2006.01)

(52) U.S. Cl.
CPC ..... *G03G 15/0891* (2013.01); *G03G 15/0822* (2013.01); *G03G 15/0839* (2013.01); *G03G 15/0877* (2013.01)

(58) Field of Classification Search
CPC ..... G03G 15/0839; G03G 15/0877; G03G 15/0822; G03G 15/0887; G03G 15/0891; G03G 15/0893; G03G 2215/0827–2215/0833
USPC ..... 399/256
See application file for complete search history.

(56) References Cited

U.S. PATENT DOCUMENTS 7,483,657 B2 1/2009 Ishida
7,734,206 B2 6/2010 Ishida
(Continued)

FOREIGN PATENT DOCUMENTS

JP 2001-265098 A 9/2001
JP 2002-072686 A 3/2002
(Continued)

OTHER PUBLICATIONS

Machine Translation of Tsurusaki, Teruaki. Developing Device. Nov. 11, 2010, Japanese Patent Office. JP2010-256701.*
(Continued)

*Primary Examiner* — David Gray
*Assistant Examiner* — Trevor J Bervik
(74) *Attorney, Agent, or Firm* — Fitzpatrick, Cella, Harper & Scinto

(57) ABSTRACT

A developing apparatus, includes a developer carrying member; a containing portion configured to contain developer; a discharge outlet through which a surplus of the developer is discharged; a first conveying portion configured to convey the developer; a second conveying portion provided downstream of the first conveying portion in a conveying direction of the first conveying portion and having a spiral blade portion configured to convey the developer in a conveying direction opposite to the conveying direction of the first conveying portion; and a disk portion provided upstream of the second conveying portion in the conveying direction of the second conveying portion, the disk portion being formed to project radially-outwardly from a whole circumference of a rotary shaft. An upstream end of the spiral blade portion of the second conveying portion in the conveying direction of the second conveying portion and the disk portion are arranged with an interval therebetween.

9 Claims, 9 Drawing Sheets

(56) References Cited

U.S. PATENT DOCUMENTS

| | | | | |
|---|---|---|---|---|
| 2009/0214266 | A1* | 8/2009 | Kato et al. | 399/254 |
| 2011/0229212 | A1* | 9/2011 | Hayashi et al. | 399/263 |
| 2012/0189352 | A1 | 7/2012 | Yamauchi et al. | |
| 2012/0251185 | A1* | 10/2012 | Matsumoto | 399/258 |
| 2013/0177338 | A1 | 7/2013 | Iida | |

FOREIGN PATENT DOCUMENTS

| | | | |
|---|---|---|---|
| JP | 2009-192701 | A | 8/2009 |
| JP | 2010-026292 | A | 2/2010 |
| JP | 2010-145618 | A | 7/2010 |
| JP | 2010-256701 | A | 11/2010 |
| JP | 2011-048184 | A | 3/2011 |
| JP | 2011-128518 | A | 6/2011 |
| JP | 2012-155144 | A | 8/2012 |
| JP | 2013-025123 | A | 2/2013 |

OTHER PUBLICATIONS

Machine Translation of Matsui, Yoji et al. Developing Device. Sep. 28, 2001, Japanese Patent Office. JP2001-265098.*

Yusuke Ishida, U.S. Appl. No. 14/330,147, filed Jul. 14, 2014.

* cited by examiner

DEVELOPING APPARATUS HAVING SUPPLY DEVICE WITH COMPOUND SPIRAL PORTIONS

BACKGROUND OF THE INVENTION

Field of the Invention

The present invention relates to a developing apparatus including a discharge outlet configured to discharge developer from a developing container.

Description of the Related Art

There has been widely used a developing apparatus configured to circulate two-component developer as a mixture of magnetic carrier and nonmagnetic toner while agitating and conveying the two-component developer by using a pair of conveying screws interposing a partition wall therebetween and arranged along a longitudinal direction of a developing container.

In the above-mentioned developing apparatus, fresh nonmagnetic toner is supplied with consumption in the nonmagnetic toner. However, it is known that, if old magnetic carrier continues to be circulated in the developing container, charging performance of the magnetic carrier to the nonmagnetic toner is gradually reduced. Accordingly, also as the control of the magnetic carrier in the developing container, there has been adopted control of maintaining constant charging performance of the magnetic carrier in the developing container in such a manner that the old magnetic carrier is discharged little by little and a fresh magnetic carrier is supplied by an amount corresponding to the discharge amount.

Japanese Patent Application Laid-Open No. 2002-72686 (Patent Literature 1) discloses a developing apparatus in which two-component developer for replenishment with an appropriate mix of the magnetic carrier and the nonmagnetic toner is supplied into the developing apparatus along with image formation, and thus the old magnetic carrier in the developing container is renewed little by little. Here, with reference to FIG. 2, the two-component developer circulating in the developing container is discharged little by little through a discharge opening 53 provided in an end in a conveying direction of a conveying screw 46.

The conveying screw 46 comprising a main spiral portion and a sub-spiral portion 50 connected to a downstream side of the main spiral portion. The main spiral portion conveys the two-component developer in a circulating direction and sends the two-component developer to the discharge opening 53. The sub-spiral portion 50 conveys the developer by the rotation in a direction opposite to a conveying direction of the main spiral portion. The sub-spiral portion 50 forces back most of the two-component developer that is conveyed by the main spiral portion to move toward the discharge opening 53 so that the sub-spiral portion 50 prevents the two-component developer from being excessively discharged through the discharge opening 53.

For the conveying screw disclosed in Patent Literature 1, an amount of the two-component developer falling into the discharge opening is fluctuated depending on a rotation angle of the sub-spiral portion. This is because a larger amount of the two-component developer falls into the discharge opening at a rotation position at which a root of the screw exposed at an end of the sub-spiral portion is faced upward than at a rotation position at which the root of the screw is faced downward. This phenomenon may cause an unstable discharge amount.

In view of the above, the configuration as described in Japanese Patent Application Laid-Open No. 2010-256701

(Patent Literature 2) is disclosed. Patent Literature 2 proposes, as illustrated in FIG. 4, the structure in which a disk portion 51 connected to an end portion, opposed to the discharge opening 53, of the sub-spiral portion 50 prevents the root of the screw from being exposed to the discharge opening 53. The sub-spiral portion 50 provided with the disk portion 51 is used.

However, the configuration disclosed in Patent Literature 2 has the following problem. That is, though discharge of the developer is essentially required to be stopped in a case where the amount of the developer in the developing container is reduced, the developer is discharged more than necessary. As a result, the developer in the developing apparatus is extremely reduced so that a quality of an output product may be degraded.

The above-mentioned problem results from the following phenomenon. That is, at a joining portion joining the sub-spiral portion 50 and the disk portion 51 together, a thickness of a blade of the sub-spiral portion 50 and a thickness of the disk portion 51 are added in the conveying direction. Accordingly, apparently, there is a portion having a locally increased blade thickness. At the portion having the locally increased blade thickness, an excessive amount of the developer is thrown up toward a developer discharge outlet, and hence discharge of the developer is not stopped.

The reason will be described below. A small amount of the developer present between an outermost circumferential surface of the sub-spiral portion 50 and an inner surface of the developing container is conveyed in a circumferential direction by the rotation of the conveying screw 46. Similarly, a small amount of the developer present between an outermost circumferential surface of the disk portion 51 and the inner surface of the developing container is also continuously conveyed in the circumferential direction by the rotation of the conveying screw 46. The developer is conveyed in the circumferential direction of the conveying screw 46 by a frictional force generated between the outermost circumferential surface of the sub-spiral portion 50 and the developer and a frictional force generated between the outermost circumferential surface of the disk portion 51 and the developer. Accordingly, in a case where the conveying screw 46 includes a portion in which the area of the outermost circumferential surface of the blade portion of the conveying screw 46 is locally increased, a force of conveying the developer in the circumferential direction is increased at this portion of the conveying screw 46, and thus the developer is thrown up at a position at which the developer is moved away from an inner wall of the developing container. A part of the thrown-up developer climbs over the disk portion 51 and falls toward a discharge screw 49, and hence discharge of the developer is accelerated.

That is, a developer throwing-up phenomenon due to the joining portion joining the sub-spiral portion 50 and the disk portion 51 occurs. The throwing-up phenomenon occurs as long as the developer is present in a slight gap between a bottom surface of the developing container and the joining portion joining the sub-spiral portion 50 and the disk portion 51 even when only a small amount of the developer is present on an upstream side in a direction of conveying the developer by the sub-spiral portion 50. Thus, though discharge of the developer is essentially required to be stopped in a case where the amount of the developer in the developing container is reduced, the developer is discharged more than necessary. As a result, the developer is extremely reduced so that the quality of an output product may be degraded.

SUMMARY OF THE INVENTION

The present invention has been made under such circumstances. The present invention provides a developing apparatus configured to discharge a surplus of developer through a discharge outlet, and also to suppress the developer throwing-up phenomenon due to a conveying portion and a disk portion provided in a path for discharging the developer toward the discharge outlet.

In order to solve the above-mentioned problem, according to an embodiment of the present invention, there is provided a developing apparatus, comprising:

a developer carrying member configured to carry developer;

a containing portion configured to contain the developer to be carried by the developer carrying member;

a discharge outlet through which a surplus of the developer in the containing portion is to be discharged;

a first conveying portion, provided in the containing portion so as to be rotatable, configured to convey the developer;

a second conveying portion provided downstream of the first conveying portion in a conveying direction of the first conveying portion so as to be rotatable together with the first conveying portion, the second conveying portion including a spiral blade portion configured to convey the developer in a conveying direction opposite to the conveying direction of the first conveying portion;

a disk portion provided upstream of the second conveying portion in the conveying direction of the second conveying portion so as to be rotatable together with the second conveying portion, the disk portion being formed to project radially-outwardly from a whole circumference of a rotary shaft; and a third conveying portion provided upstream of the disk portion in the conveying direction of the second conveying portion so as to be rotatable together with the second conveying portion, the third conveying portion being configured to convey the developer that climbs over the disk portion, toward the discharge outlet, wherein an upstream end of the spiral blade portion of the second conveying portion in the conveying direction of the second conveying portion and the disk portion are arranged with an interval therebetween.

Further features of the present invention will become apparent from the following description of exemplary embodiments with reference to the attached drawings.

DESCRIPTION OF THE EMBODIMENTS

Now, the embodiments of the present invention will be described in detail with reference to the drawings. The present invention may be similarly carried out in various types of image forming apparatus using a common developing apparatus. The present invention may be carried out regardless of types of the image forming apparatus, such as an intermediate transfer type, a recording material conveyance type, a tandem type, a single-drum type, a full-color type, and a monochrome type.

In the embodiment, only a substantial part for formation and transfer of a toner image will be described. By adding necessary apparatus, equipment, and housing structure, the present invention may be carried out for various applications such as a printer, various printing machines, a copying machine, a facsimile, and a multifunction peripheral.

Note that, general matters of the image forming apparatus disclosed in Patent Literature 1 are not shown, and redundant description thereof is omitted.

<Image Forming Apparatus>

Figure 1:
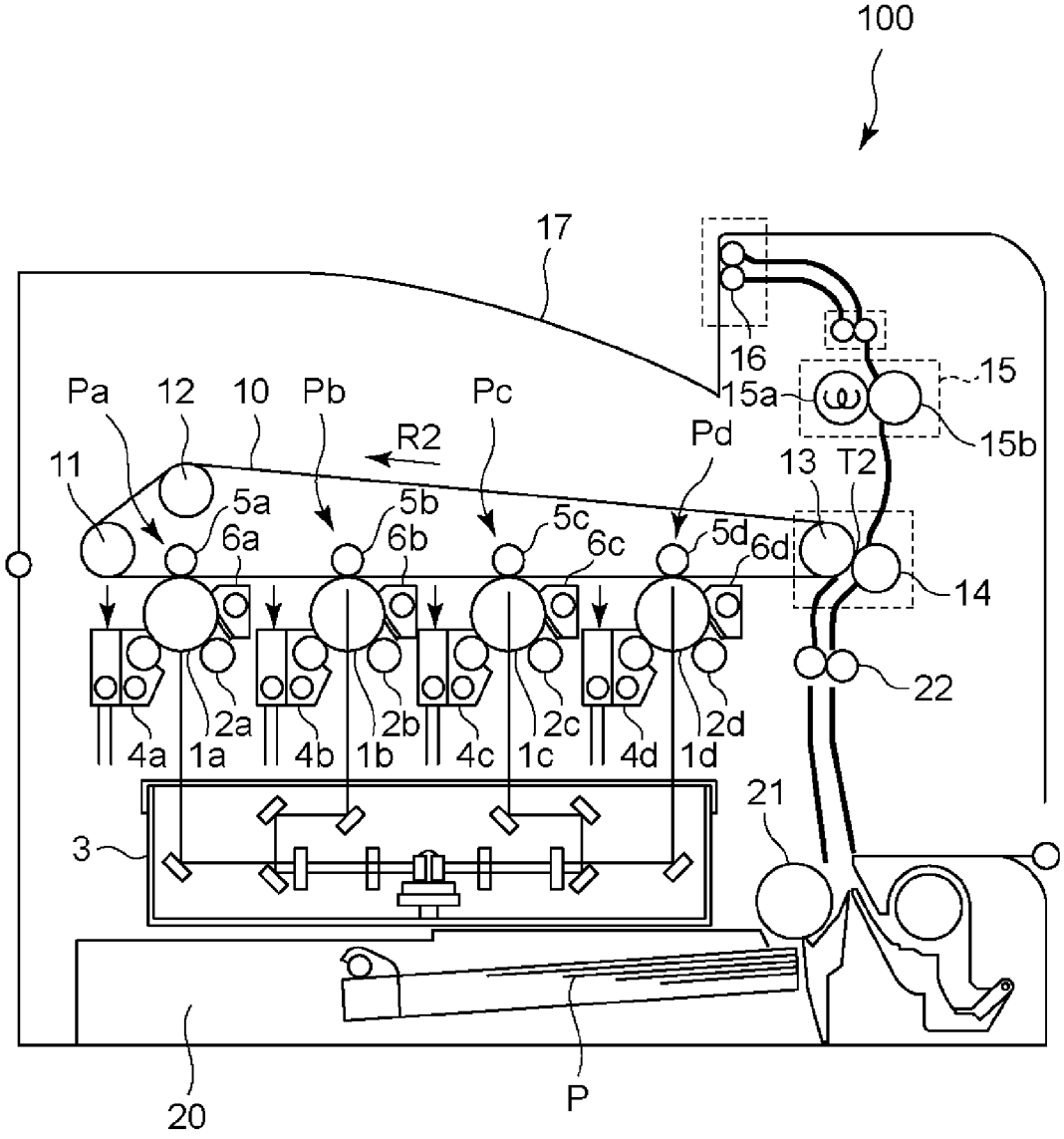
FIG. 1 is an explanatory diagram of a configuration of an image forming apparatus according to a first embodiment.

FIG. 1 is an explanatory diagram of a configuration of an image forming apparatus according to a first embodiment.

As illustrated in FIG. 1, an image forming apparatus 100 is a full-color printer of a tandem intermediate transfer type, including image forming portions Pa, Pb, Pc, and Pd arranged along a downward-facing surface of an intermediate transfer belt 10.

In the image forming portion Pa, a yellow toner image is formed on a photosensitive drum 1*a* and is then primarily transferred onto the intermediate transfer belt 10. In the image forming portion Pb, a magenta toner image is formed on a photosensitive drum 1*b* and is then primarily transferred to be superimposed on the yellow toner image of the intermediate transfer belt 10. In the image forming portions Pc and Pd, a cyan toner image and a black toner image are formed on photosensitive drums 1*c* and 1*d*, respectively, and are also primarily transferred sequentially onto the intermediate transfer belt 10 in a superimposed manner.

Four color toner images primarily transferred onto the intermediate transfer belt 10 are conveyed to a secondary transfer portion T2 and, collectively and secondarily transferred onto a recording material P.

In a case of a simplex mode in which an image is formed on one surface of the recording material P, the recording material P on which the four color toner images have been secondarily transferred is heated and pressurized by a fixing device 15 to have the toner image fixed onto a surface of the recording material P, and is then delivered through delivery rollers 16 onto an upper tray 17.

In a case of a duplex mode in which images are formed on both surfaces of the recording material P, a front surface and a rear surface of the recording material P having the image formed on the front surface of the recording material P is reversed through a duplex path (not shown), and is conveyed again to the secondary transfer portion T2. The recording material P, which has undergone a back surface recording in the same manner as the image forming process of the front surface recording, is delivered through the delivery rollers 16 onto the upper tray 17.

A separation roller 21 separates one by one the recording materials P fed out from a recording material cassette 20, and feeds the recording material P to registration rollers 22. The registration rollers 22 in a stop state receive the recording material P so as to put the recording material P on standby, and convey the recording material P into the secondary transfer portion T2 in synchronization with timing of the toner image transferred on the intermediate transfer belt 10.

The fixing device 15 brings a pressure roller 15*b* into pressure contact with a fixing roller 15*a* including a heater, to form a heating nip. While nipped and conveyed in the heating nip, the recording material P is heated and pressurized. Thus, the toner image is fused, and a full-color image is fixed onto the surface of the recording material P.

The image forming portions Pa, Pb, Pc, and Pd have substantially the same structure except that developing apparatus 4*a*, 4*b*, 4*c*, and 4*d* use different color toners of yellow, magenta, cyan, and black, respectively. The image forming portion Pa will be described below, and the other image forming portions Pb, Pc, and Pd are described by replacing the suffix of the reference symbol "a" in the description with "b", "c", and "d".

The image forming portion Pa includes a charging roller 2*a*, an exposure device 3, the developing apparatus 4*a*, a primary transfer roller 5*a*, and a cleaning apparatus 6*a*, which are arranged around the photosensitive drum 1*a*.

The photosensitive drum 1*a* has a photosensitive layer having a negative charge polarity, which is formed on an outer circumferential surface of an aluminum cylinder, and rotates at a process speed switchable in a plurality of steps. An oscillation voltage of an AC voltage superimposed on a DC voltage is applied to the charging roller 2*a*. Then, the charging roller 2*a* is rotated in association with the rotation of the photosensitive drum 1*a* so as to uniformly charge the surface of the photosensitive drum 1*a* to a negative potential.

The exposure device 3 scans a laser beam, ON-OFF modulated in accordance with scan line image data expanded from a yellow color separation image, by a rotary mirror to write the electrostatic image on the surface of the charged photosensitive drum 1*a*. The developing apparatus 4*a* agitates and charges two-component developer, causes a developing sleeve 43 to carry the two-component developer in a magnetic brush state, and rubs the photosensitive drum 1*a*. An oscillation voltage of an AC voltage superimposed on a DC voltage is applied to the developing sleeve 43, and thus the nonmagnetic toner charged to a negative polarity is moved to the electrostatic image (exposed portion) having a positive polarity relative to the developing sleeve 43. Thus, the electrostatic image is reversely developed.

The primary transfer roller 5*a* presses an inner surface of the intermediate transfer belt 10 so as to form a primary transfer portion between the photosensitive drum 1*a* and the intermediate transfer belt 10. A positive DC voltage is applied to the primary transfer roller 5*a* to primarily transfer a negative toner image borne on the photosensitive drum 1*a* onto the intermediate transfer belt 10 passing through the primary transfer portion.

The intermediate transfer belt 10 is passed over and supported by a tension roller 12, a driving roller 11, and a stretching roller 13, and is driven by the driving roller 11 to rotate in a direction indicated by an arrow R2. A secondary transfer roller 14 abuts on the intermediate transfer belt 10 having the inner surface stretched by the stretching roller 13 connected to a ground potential, to form the secondary transfer portion T2. A positive DC voltage is applied to the secondary transfer roller 14 to secondarily transfer the toner image borne on the intermediate transfer belt 10 onto the recording material P.

<Developing Apparatus>

Figure 2:
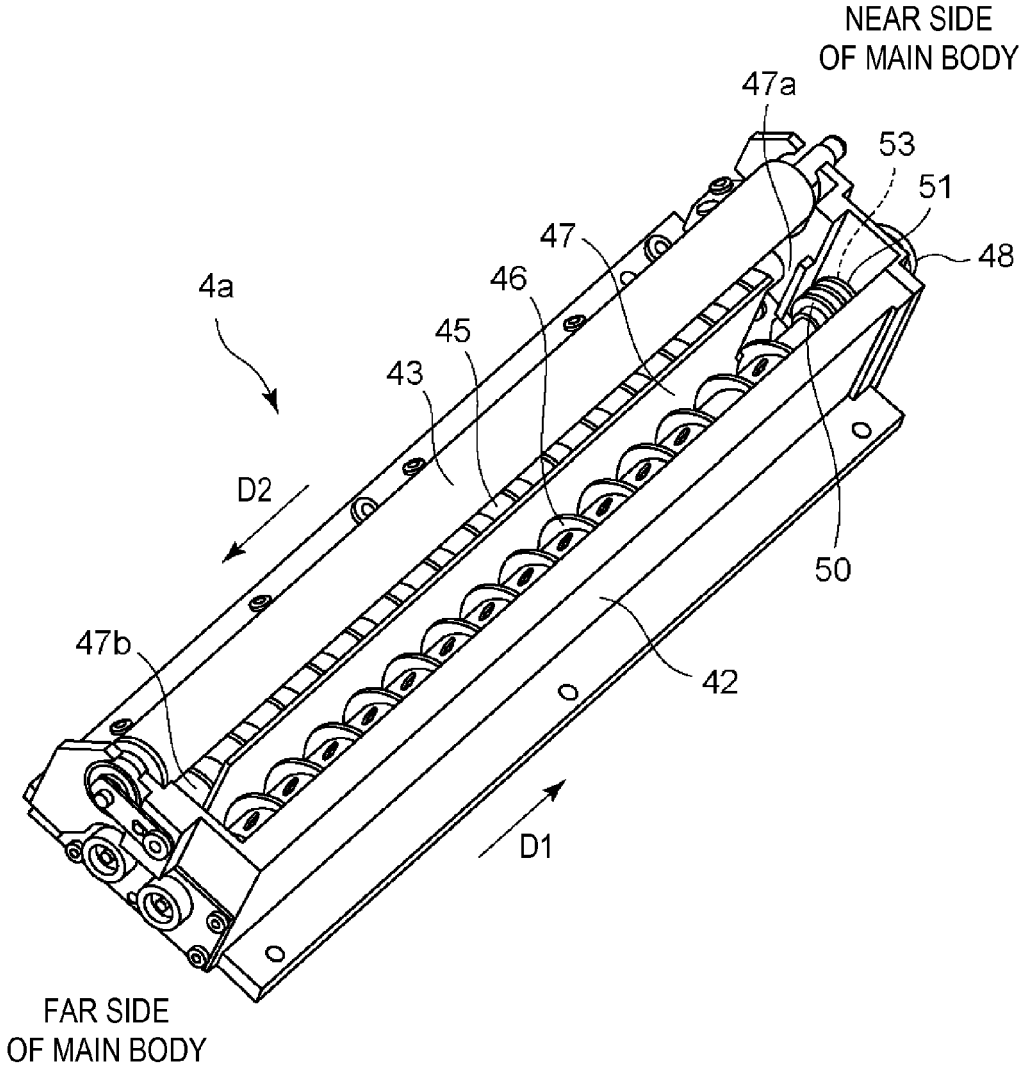
FIG. 2 is a perspective view illustrating an internal structure of a developing apparatus.
Figure 3:
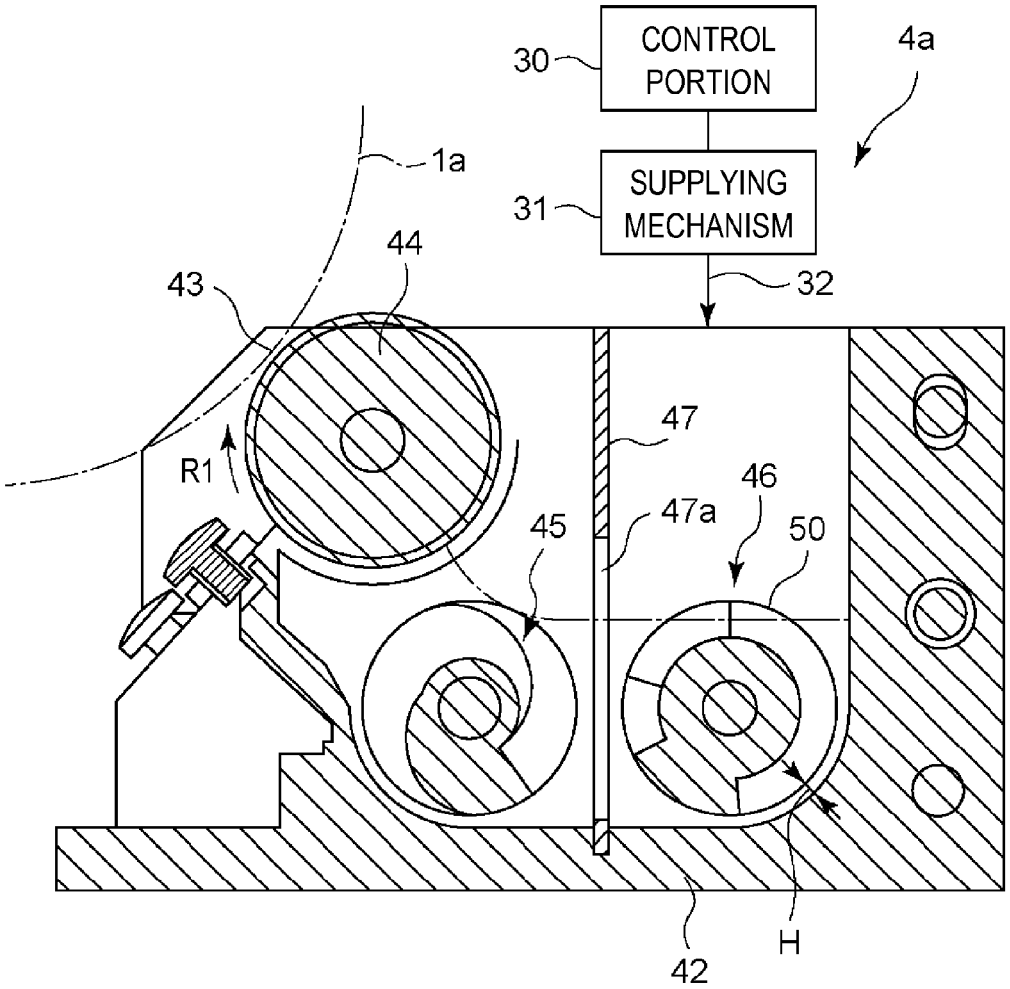
FIG. 3 is a cross-sectional view of the developing apparatus viewed from a far side of the image forming apparatus.
Figure 4:
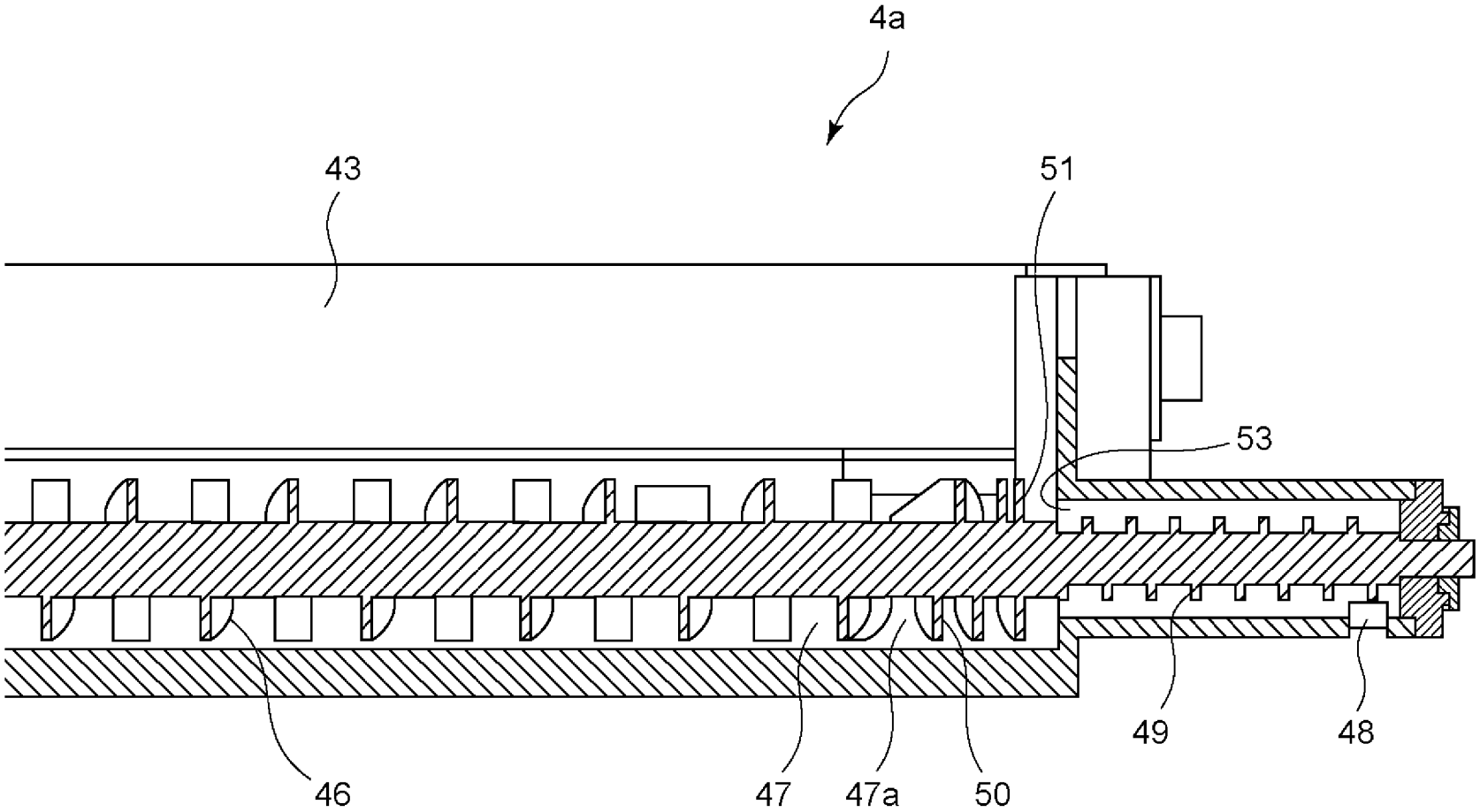
FIG. 4 is an enlarged cross-sectional view of a vicinity of a developer discharge outlet.
Figure 5:
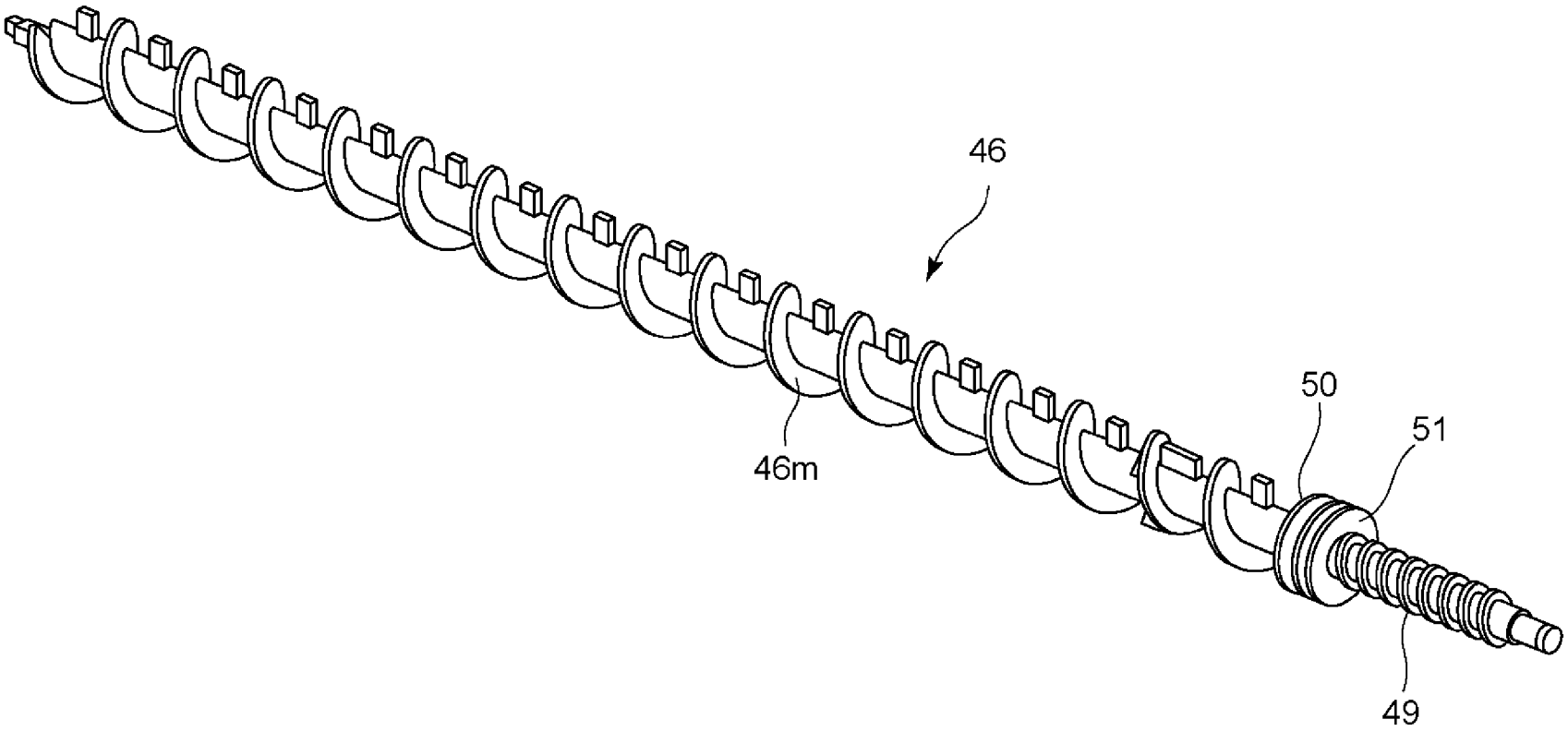
FIG. 5 is a perspective view of a conveying screw including a sub-spiral portion.

FIG. 2 is a perspective view illustrating internal structure of the developing apparatus. FIG. 3 is a cross-sectional view of the developing apparatus viewed from a far side of the image forming apparatus. FIG. 4 is an enlarged cross-sectional view of a vicinity of a developer discharge outlet. FIG. 5 is a perspective view of a conveying screw provided with a sub-spiral portion.

As illustrated in FIG. 2, a developing container as a containing portion contains the two-component developer including nonmagnetic toner and magnetic carrier. A mixing ratio of the nonmagnetic toner and the magnetic carrier is approximately 1:9 in weight ratio. Here, the mixing ratio of the nonmagnetic toner and the magnetic carrier is adjusted appropriately depending on a charged amount of the toner, a particle diameter of the carrier, and a configuration of the image forming apparatus 100 (FIG. 1). However, the mixing ratio is not necessarily limited to this numeric value.

FIG. 3 illustrates a cross-section of the developing apparatus 4*a* viewed from the far side of the image forming apparatus 100 (FIG. 1), and the inside of a sheet of FIG. 3 corresponds to a front side from which the two-component developer is discharged. As illustrated in FIG. 3, in the developing apparatus 4*a*, the developing container 42 is provided with an opening portion formed in a developing region opposed to the photosensitive drum 1*a*, and the developing sleeve 43 as a developer carrying member is rotatably provided so as to be partially exposed through the opening portion. A magnet 44 having a plurality of stationary magnetic poles is arranged inside the developing sleeve 43 in an irrotational manner. The developing sleeve is made of a nonmagnetic material. The developing sleeve 43 rotates in a direction indicated by an arrow R1 at the time of developing operation, keeps the two-component developer in the developing container 42 in a layer form with the aid of a magnetic force of the magnet 44, and conveys the two-component developer to the developing region. The developing sleeve 43 supplies only the nonmagnetic toner to the photosensitive drum 1*a* in the developing region, and develops the electrostatic image formed on the photosensitive drum 1*a*. After the electrostatic image is developed, the two-component developer remaining on the developing sleeve 43 is collected into the developing container 42 by the rotation of the developing sleeve 43.

The developing apparatus 4*a* has an automatic developer discharging function of maintaining a constant amount of the two-component developer in the developing container 42 even when a rotation speed of a conveying screw 46 is switched over.

As illustrated in FIG. 2, a discharge opening 53 (positioned behind a collar portion 51) configured to discharge an excessive amount of the developer is formed in one of internal end surfaces in a longitudinal direction of the developing container 42. Further, an inside of the developing container 42 is partitioned by a partition wall 47 in which opening portions 47*a*, 47*b* configured to deliver the two-component developer are formed at both ends of the partition wall 47.

A pair of conveying screws 45, 46 is arranged with the partition wall 47 being interposed between the pair of conveying screws 45, 46. The conveying screws 45, are set to convey the two-component developer in opposite directions, respectively. The conveying screw 46 agitates and conveys the two-component developer in a direction indicated by an arrow D1, and the conveying screw 45 agitates and conveys the two-component developer in a direction indicated by an arrow D2. Thus, the two-component developer circulates in the developing container 42.

At this time, through the opening portion 47*a* provided on the side of the sub-spiral portion, the two-component developer is smoothly delivered from the conveying screw 46 as an example of a first conveying member to the conveying screw 45 as an example of a second conveying member. Furthermore, through the opening portion 47*b* provided on the side opposite to the sub-spiral portion, the two-component developer is smoothly delivered from the conveying screw 45 as the example of the second conveying member to the conveying screw 46 as the example of the first conveying member.

A return screw 50 is connected to a downstream side of the conveying screw 46 in a conveying direction of the two-component developer by the conveying screw 46. The return screw 50 conveys the two-component developer so as to force back the two-component developer from an outside of a circulation path of the two-component developer into the circulation path. The opening portion 47*a* is provided at a position opposed to a joint between a main spiral portion (46*m*: FIG. 5) and the return screw 50 (sub-spiral portion) of the conveying screw 46. The two-component developer is delivered from the conveying screw 46 to the conveying screw 45 through the opening portion 47*a*.

As illustrated in FIG. 4, the discharge opening is provided upstream of the return screw 50 in a conveying direction of the two-component developer by the return screw 50. A part of the circulating two-component developer is discharged through the discharge opening 53 to the outside of the developing container 42. Most of the two-component developer conveyed by the main spiral portion of the conveying screw 46 toward the discharge opening 53 is forced back by the return screw 50, and thus is not discharged through the discharge opening 53. A part of the two-component developer that is not forced back by the return screw 50 is discharged through the discharge opening 53 out of the circulation path in the developing container 42.

A length, a diameter, and a pitch of the return screw 50 are changed as appropriate depending on the configuration of the developing apparatus 4*a*, a discharging condition, an amount of the two-component developer in the developing container 42, and a target discharge amount. For example, when the length of the return screw 50 is extremely large, discharge of the two-component developer is suppressed more than necessary, with the result that reduction in charging performance of the two-component developer in the developing container 42 is progressed. Conversely, when the length of the return screw 50 is extremely small, the two-component developer is discharged more than necessary, and the amount of the two-component developer in the developing container 42 is insufficient so that the development may be failed.

According to the embodiment, the disk-like collar portion 51 as an example of a disk portion configured to cover the discharge opening 53 is provided on the most upstream side of the return screw 50 in the conveying direction of the return screw 50. The collar portion 51 is formed to project radially-outwardly from a whole circumference of a rotary shaft.

The collar portion 51 reduces a difference in inertial force of the two-component developer that is conveyed toward the discharge opening 53 by a difference in conveying performance between the main spiral portion and the return screw 50 of the conveying screw 46. The collar portion 51 prevents the two-component developer from falling from a discontinuity of the conveying blade of the return screw 50 into the discharge opening 53 to stabilize the discharge amount of the two-component developer. The collar portion 51 covers an end of the return screw 50 opposed to the discharge opening 53, and thus does not expose a root of the screw to the discharge opening 53. By use of the return screw provided with the collar portion 51, a necessary discharge amount is secured even when the rotation speed of the conveying screw 46 is switched over to a lower speed. Even when the rotation speed of the conveying screw 46 is switched over to a higher speed, the discharge amount of the two-component developer is not abruptly increased.

A discharge screw 49 connected to the return screw 50 is extended through a center of the discharge opening 53. When the developer is supplied so as to compensate the toner consumed with the image formation, an amount of the developer in the developing container is increased because of the supply of fresh carrier. The discharge screw 49 discharges a surplus of the developer that is newly increased by the supply. Specifically, the discharge screw 49 conveys the surplus of the developer that climbs over the collar portion 51 and falls onto the discharge screw 49, through the discharge opening 53. Then, the discharge screw 49 conveys the developer to a developer discharge outlet 48 to discharge the developer out of the developing apparatus 4*a*.

As illustrated in FIG. 5 with reference to FIG. 2, in the conveying screw 46 as the example of the first conveying member, the sub-spiral portion (50) is connected to the main spiral portion 46*m*. The sub-spiral portion (50) conveys the developer flowing toward the discharge opening 53 in a direction opposite to the flow of the developer. The main spiral portion 46*m* conveys the developer in the circulation path of the two-component developer toward the discharge opening 53.

<Supply Control of Two-Component Developer for Replenishment>

As illustrated in FIG. 3, the developer is supplied in order to compensate the toner consumed with the image formation. Developer for replenishment is supplied by a supplying mechanism 31 to an upstream side (far side of a main body) of the conveying screw 46 in the developing container 42. The developer is supplied into the developing apparatus 4*a* from a hopper of the supplying mechanism 31 by the rotation of a supplying screw 32, and is received from a supply inlet provided in an upper portion of the developing container 42. The two-component developer for replenishment includes magnetic carrier of a predetermined ratio (approximately 10% in weight ratio) in nonmagnetic toner for replenishment. However, the mixing ratio of the magnetic carrier is not limited thereto.

A supply amount of the two-component developer for replenishment is approximately determined based on the number of revolutions of the supplying screw 32 of the supplying mechanism 31. A control portion 30 controls ON/OFF of rotation and the rotation speed of the supplying screw 32, and supplies the two-component developer for replenishment so that a toner density of the two-component developer contained in the developing container 42 is maintained constant.

At this time, the amount of the two-component developer in the developing container 42 is gradually increased with the image formation. The nonmagnetic toner is consumed with the image formation, but the magnetic carrier is not consumed to remain and keep circulating in the developing container 42. Thus, the amount of the two-component developer in the developing container 42 is increased. In a case where the amount of the two-component developer is increased, the developer climbs over the return screw 50 and the collar portion 51 illustrated in FIG. 4, and falls to the discharge opening 53. Then, the developer is delivered to the discharge screw 49, and is conveyed to the developer discharge outlet 48. The developer conveyed to the developer discharge outlet 48 is discharged from the developer discharge outlet 48 to flow into a developer collecting pipe (not shown). The developer flowing through the developer collecting pipe is collected, and the collected developer is stored altogether in a collecting container (not shown).

In this way, the consumed nonmagnetic toner is supplied with the two-component developer for replenishment, and at the same time, the two-component developer in the developing container 42 containing an excessive amount of the magnetic carrier is discharged little by little. The two-component developer is renewed automatically and gradually so that the amount of the two-component developer in the developing container 42 is maintained constant, and thus the automatic developer discharging function is realized.

First Embodiment

Figure 8:
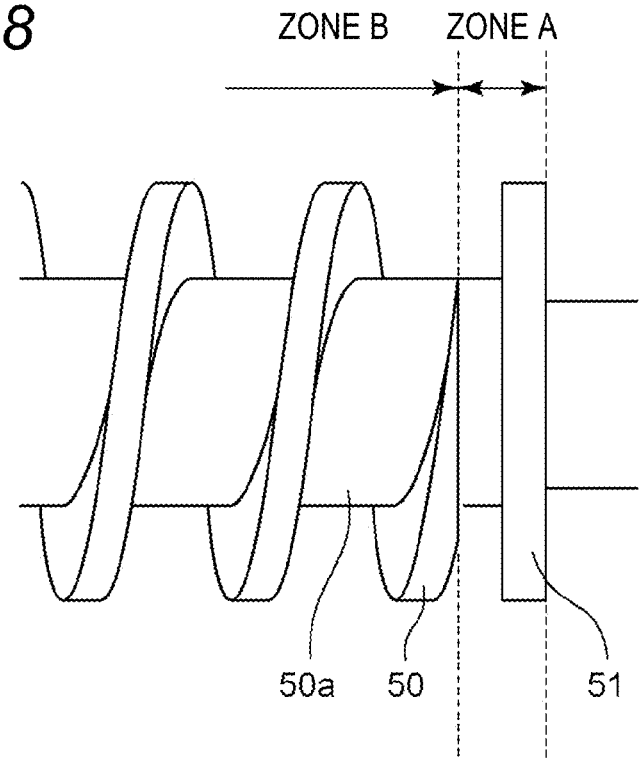
FIG. 8 is an enlarged view of a vicinity of a disk portion of a conveying screw according to the first embodiment.

Next, a structure configured to suppress the throwing-up of the developer in a vicinity of the disk portion according to the first embodiment will be described in detail. FIG. 8 is an enlarged view of the collar portion and the return screw 50 according to the first embodiment. In the first embodiment as illustrated in FIG. 8, a region including only a screw rotary shaft 50*a* is present between the collar portion 51 and the return screw 50. That is, the return screw 50 and the collar portion 51 are not directly joined together. In order to describe this effect, a comparative example as the conventional art will be first described in comparison with the present invention.

Figure 6:
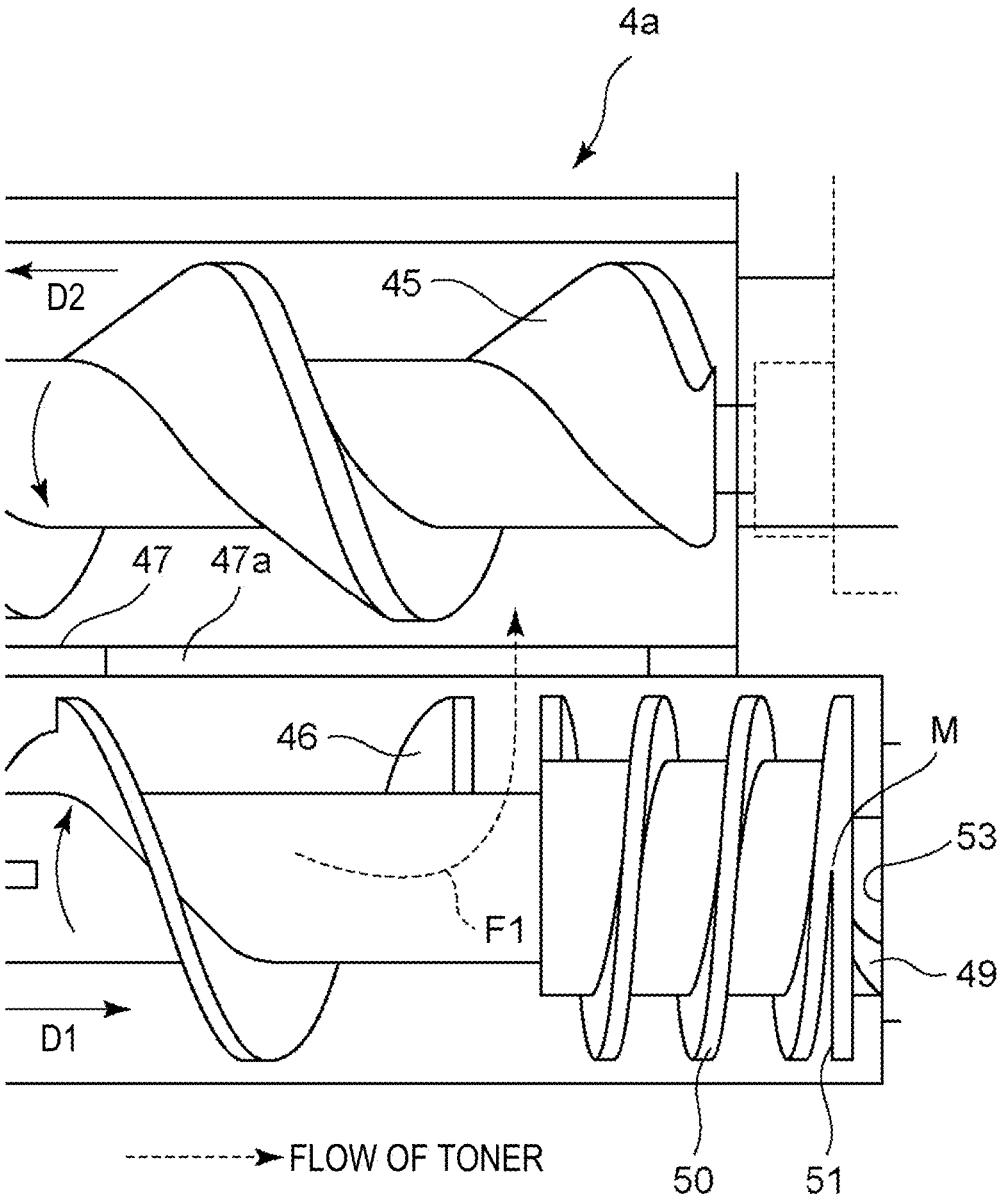
Prior Art FIG. 6
FIG. 6 is a plan view of a developing apparatus provided with a conventional conveying screw.
Figure 7:
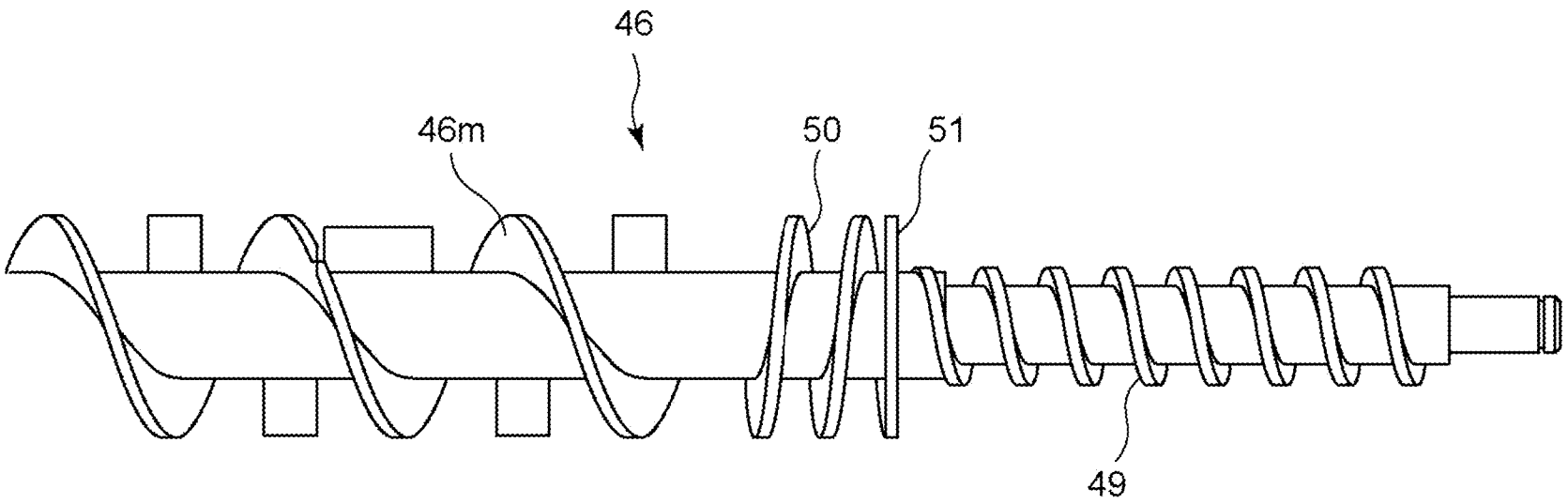
Prior Art FIG. 7
FIG. 7 is an explanatory diagram of the conventional conveying screw.

FIG. 6 is a plan view of the developing apparatus in a vicinity of the opening portion 47*a* according to the comparative example. FIG. 7 is an explanatory diagram of the conveying screw 46 according to the comparative example.

As illustrated in FIG. 7, the first conveying member 46 includes the main spiral portion 46*m* configured to convey the developer in the circulation path toward the discharge opening 53. Furthermore, the first conveying member 46 includes the sub-spiral portion 50 configured to convey the developer so as to return the developer into the circulation path against a flow of the developer flowing toward the discharge opening 53. That is, the sub-spiral portion 50 includes a spiral blade portion configured to convey the developer in a direction opposite to the conveying direction of the main spiral portion 46*m*. The disk portion 51 corresponds to the collar portion 51 connected to the sub-spiral portion (hereinafter referred to as "return screw") 50 on the side opposite to the opening portion 47*a*. The return screw 50 and the collar portion 51 have the same diameter.

Figure 9:
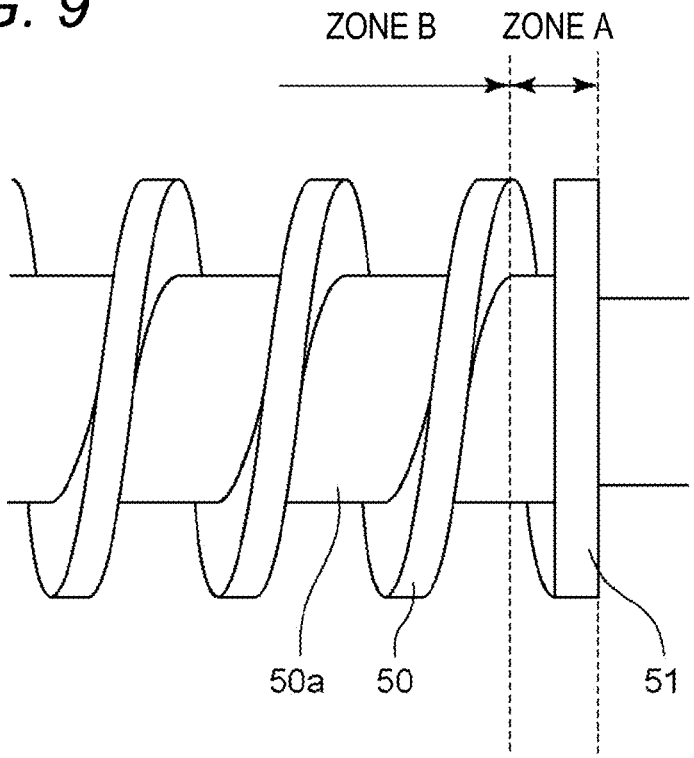
Prior Art FIG. 9
FIG. 9 is an enlarged view of a vicinity of a disk portion of the conventional conveying screw.

FIG. 9 is an enlarged view of a joining portion joining the collar portion 51 and the return screw 50 according to the comparative example.

In the longitudinal direction of FIG. 9, the vicinity of the joining portion of the collar portion 51 and the return screw 50 is represented by a zone A, and other part of the return screw 50 than the zone A is represented by a zone B. In the zone B, a width (thickness of a rim of the blade portion) of an outermost diameter portion of the blade portion of the return screw 50 is formed to be constant in a rotation axis direction. Meanwhile, in the zone A, the joining portion of the collar portion 51 and the return screw 50 has a thickness of a sum of thicknesses of respective blades. Accordingly, apparently, a thickness of the outermost diameter portion of the blade portion of the return screw 50 is locally increased at the joining portion of the collar portion 51 and the return screw 50. That is, in the zone A, a minimum value of the width (thickness of the rim of the blade portion) of the outermost diameter portion of the return screw 50 in the rotation axis direction exists at a portion other than the joining portion of the collar portion 51 and the return screw 50. Furthermore, in the zone A, a maximum value of the width (thickness of the rim of the blade portion) of the outermost diameter portion of the return screw 50 in the rotation axis direction exists at a most downstream portion M (FIG. 6) in the conveying direction of the return screw 50 in the joining portion of the collar portion 51 and the return screw 50.

Here, the conveying screw 46 rotates clockwise when viewed from the discharge opening 53. The joining portion of the return screw 50 and the collar portion 51 passes the same point once for each revolution period with the rotation of the conveying screw 46. As described above, by the rotation of the return screw 50 and the collar portion 51, the return screw 50 and the collar portion 51 apply a frictional force to a small amount of the developer that is present in a clearance portion H formed between the outermost diameter portion of the return screw 50 and an inner surface of the developing container and between the outermost diameter portion of the collar portion 51 and the inner surface of the developing container. Thus, the small amount of the developer is conveyed by the frictional force.

That is, the above-mentioned frictional force exerted on the developer present in the clearance portion H is in proportion to an axial length (thickness of the blade) of the outermost diameter portion of the blade portion of the return screw 50 and an axial length (thickness of the blade) of the outermost diameter portion of the blade portion of the collar portion 51. As a result, the following phenomenon occurs. The conveying screw 46 rotates clockwise when viewed from the discharge opening 53, and it is assumed that a vertical top position of the clockwise rotation is twelve o'clock. The developer present at a bottom of the zone A is conveyed by the rotation of the conveying screw 46 to a position of nine o'clock along the inner surface of the developing container. However, when the joining portion of the return screw 50 and the collar portion 51, i.e., a portion having a locally increased width (thickness) of the rim of the blade portion in the rotation axis direction passes the position of nine o'clock, a conveying force is increased as compared to a case where other portion than the joining portion passes the position of nine o'clock. Accordingly, after passing the position of nine o'clock, the developer is thrown up vertically upward due to the inertial force. Then, the thrown-up developer falls radially. One part of the thrown-up developer falls to the return screw 50, and another part of the thrown-up developer falls to the discharge screw 49 so as to be discharged.

That is, when the amount of the developer in the developing container 42 is reduced, discharge of the developer is essentially required to be stopped. However, as long as even a small amount of the developer is present in the zone A, the developer is thrown up every time the conveying screw 46 makes one revolution, and thus the developer is conveyed to the developer discharge outlet 48. Accordingly, there has been a problem in that the amount of the developer is extremely reduced.

Accordingly, in the first embodiment, as illustrated in FIG. 8, the blade portion of the return screw 50 and the blade portion of the collar portion 51 are not joined together. That is, the upstream end of the return screw 50 in the conveying direction of the return screw 50 and the collar portion 51 are arranged with an interval (space) therebetween.

With this configuration, it is possible to suppress apparent and local increase of the thickness of the rim of the blade portion of the screw due to the joining portion of the blade portion of the return screw 50 and the blade portion of the collar portion 51. As a result, excessive discharge of the developer is suppressed, and thus the amount of the developer can be controlled suitably.

Figure 10:
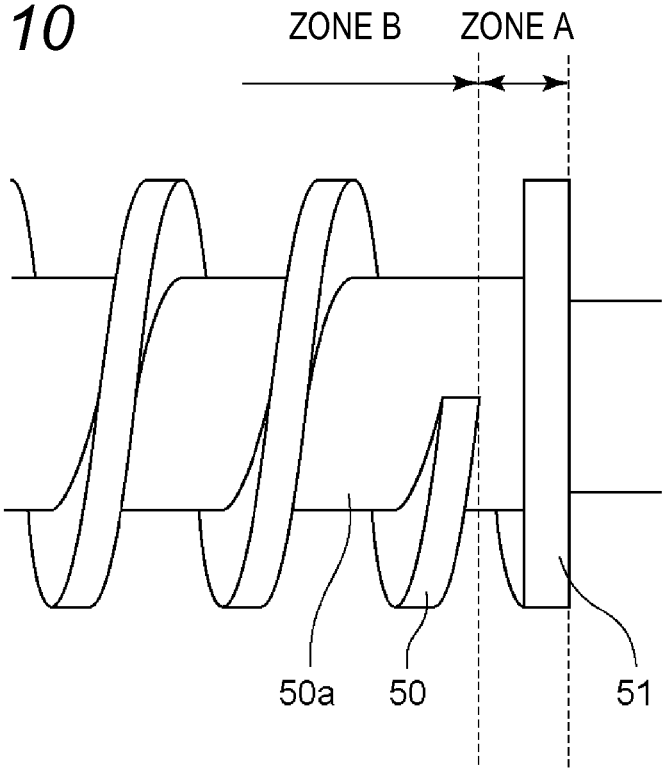
FIG. 10 is an enlarged view of a vicinity of the disk portion of the conveying screw according to the first embodiment.

Note that, in the first embodiment, as illustrated in FIG. 8, the interval is provided between the return screw 50 and the collar portion 51. In the first embodiment, a length of this interval is set to be substantially equal to the thickness of the collar portion 51. However, the present invention is not limited to this example in order to obtain the effects of the present invention. As long as the developer can pass through this interval, the effects of the present invention are not deteriorated even if the length of this interval is set freely to some extent. However, a length of this interval larger than necessary leads to upsizing of the apparatus, and hence it is preferred that this interval have a length of 1 mm or more and 5 mm or less. Furthermore, a shape of an end portion of the blade of the return screw 50 on an upstream side in the conveying direction of the developer by the return screw 50 is not limited to the shape illustrated in FIG. 8. For example, also a shape illustrated in FIG. 10 may provide the effects of the present invention. Here, the shape of the end portion of the return screw 50 as illustrated in FIG. 8 is a shape cut perpendicularly to the screw rotary shaft 50*a*, and the shape of the end portion of the return screw 50 as illustrated in FIG. 10 is a shape cut in parallel to the screw rotary shaft 50*a*. Needless to say, even when the end portion of the return screw 50 has a shape cut along a direction other than the direction perpendicular or parallel to the screw rotary shaft 50*a*, as long as the interval between the return screw 50 and the collar portion 51 is suitably formed, the effects of the present invention can be obtained.

Note that, as illustrated in FIG. 10, in a case where the spiral blade portion of the return screw 50 is cut in parallel to the screw rotary shaft 50*a*, there may be another problem in that a cut end surface of the blade portion kicks up the developer. In order to address this problem, the cut end surface of the blade portion perpendicular to the screw rotary shaft 50*a* as illustrated in FIG. 8 is preferred to the cut end surface of the blade portion parallel to the screw rotary shaft 50*a* as illustrated in FIG. 10. That is, it is more preferred that the rim of the blade portion be tapered so that an axial length of the outermost diameter portion of the blade portion becomes gradually smaller toward the upstream side in the conveying direction of the return screw 50. Furthermore, a screw diameter of the blade portion of the return screw 50 on the upstream side in the conveying direction may become gradually smaller toward the upstream side in the conveying direction of the return screw 50. This configuration provides the effects of suppressing the kicking-up of the developer by the end portion of the blade portion of the return screw 50 at a position at which the screw diameter is sharply changed.

Second Embodiment

The second embodiment is different from the first embodiment in the following points, but is similar to the first embodiment in the other points. Accordingly, in the following description of the second embodiment, components corresponding to the components of the first embodiment are denoted by the same reference symbols, and detailed description thereof is omitted.

Figure 11:
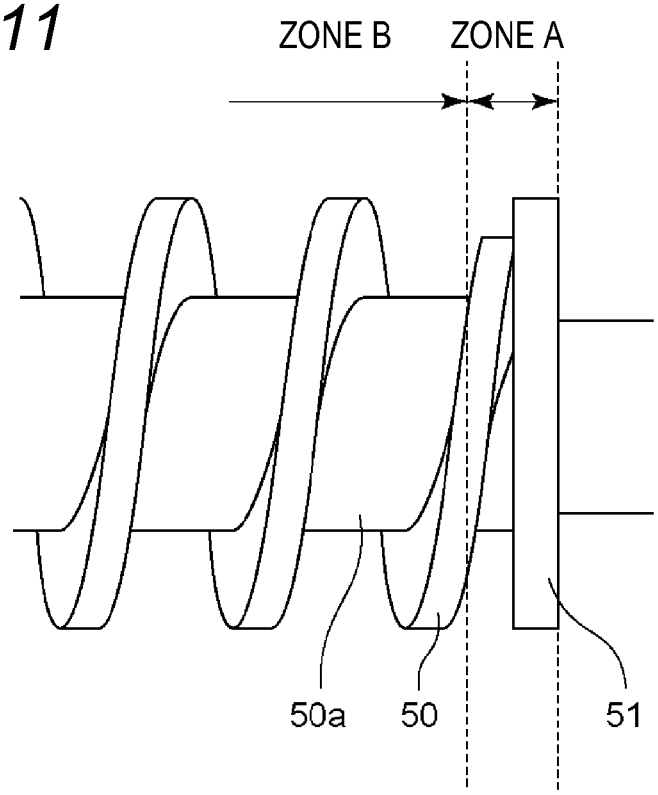
FIG. 11 is an enlarged view of a vicinity of a disk portion of a conveying screw according to a second embodiment.

The second embodiment has a feature in that, as illustrated in FIG. 11, in the vicinity of the joining portion joining the return screw 50 and the collar portion 51, a diameter of the blade portion of the return screw 50 is set to be smaller than a diameter of the collar portion 51. In the second embodiment, the return screw 50 and the collar portion 51 are joined together, but the diameter of the blade portion of the return screw 50 is locally reduced at an upstream end portion of the return screw 50. Accordingly, in both of the zones A, B, a length of a maximum outer diameter portion of the blade portion in the rotation axis direction is not locally increased. As a result, it is possible to obtain the effects of suppressing excessive discharge caused by the thrown-up of the developer. In addition, in the second embodiment, though the diameter of the blade portion is small, the blade portion of the return screw 50 is extended to the joining portion of the collar portion 51 and the return screw 50. Thus, as compared to the first embodiment, a conveying region of the return screw 50 can be secured. Note that, at a portion other than the vicinity of the joining portion, the return screw 50 has substantially the same diameter as the diameter of the collar portion 51. That is, a maximum diameter of the blade portion of the return screw 50 is substantially equal to the diameter of the collar portion 51.

In the second embodiment, as illustrated in FIG. 11, a length of a region of a small diameter of the blade of the return screw 50 in the rotation axis direction is set to a length equal to the thickness of the collar portion 51 in the rotation axis direction. Furthermore, the region of the return screw 50 having the small diameter of the blade is set to have 90% of a diameter of the blade of other region of the return screw 50. However, the present invention is not limited to the above-mentioned condition in order to obtain the effects of the present invention. Similarly to the first embodiment, as long as the developer can pass through the region between the end portion of the return screw 50 in the zone B and the collar portion 51 without clogging, the effects of the present invention are not deteriorated even if the region in the rotation axis direction is set freely to some extent. Furthermore, as long as the developer can pass through an interval between an inner wall of the developing container 42 and the blade portion of the return screw 50, it is only necessary that a small diameter of the blade portion be set within a range larger than a diameter of the screw rotary shaft 50*a* and smaller than the diameter of the collar portion 51. In the above-mentioned range, as the diameter of the blade portion becomes larger, the performance to convey the developer becomes higher. Furthermore, in the second embodiment, the diameter of the blade portion is changed in a binary manner, but the diameter of the blade portion may be reduced in steps. Furthermore, the diameter of the blade portion may be reduced smoothly toward the joining portion of the collar portion 51 and the return screw 50.

In the embodiment, the diameter of the blade portion of the return screw 50 is reduced only at the most upstream end portion of the return screw 50, but the present invention is not limited thereto. The diameter of the blade portion of the return screw 50 may be reduced in the whole region in the longitudinal direction of the return screw 50.

Other Example

The collar portion 51 only needs to have a circumferential surface at an outer periphery thereof. In addition to the flat-plate-like shape described in the first and second embodiments, the collar portion 51 may have such an appearance that a surface of revolution such as a conical surface and a spherical surface is opposed to the discharge opening.

As illustrated in FIG. 2, in the first and second embodiments, the sub-spiral portion 50 is provided on the conveying screw 46 provided away from the developing sleeve to control the discharge amount of the two-component developer. In contrast to this, the sub-spiral portion may be provided on a downstream side of the conveying screw 45 provided close to the developing sleeve 43 to control the discharge amount of the two-component developer. That is, the two-component developer immediately after the non-magnetic toner's consumption in the developing sleeve 43 may be discharged through a discharge opening provided in an end downstream of the conveying screw 45.

According to the present invention, a developing apparatus configured to discharge a surplus of developer through a discharge outlet can suppress a thrown-up developer which might otherwise be caused by a joining portion joining an upstream side of a disk portion and a conveying portion, the disk portion being provided in a path through which the developer is discharged toward the discharge outlet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-136150, filed Jun. 28, 2013, which is hereby incorporated by reference herein in its entirety.

What is claimed is:

1. A developing apparatus, comprising:

a containing portion configured to contain developer including toner and carrier, the containing portion including a first chamber and a second chamber provided adjacent to the first chamber and communicated with the first chamber to form a circulation path through which the developer circulates;

a supplying device configured to supply the developer to the containing portion;

a first conveying member configured to convey the developer, the first conveying member being provided rotatably in the first chamber, the first conveying member comprising:

a rotatable rotary shaft portion;

a first spiral portion extending in a longitudinal direction of the first chamber in the circulation path in the first chamber and provided around the rotary shaft portion, with a conveying direction of the first spiral portion being a forward direction relative to a direction in which the developer in the circulation path in the first chamber circulates;

a second spiral portion provided on the rotary shaft portion downstream of the first spiral portion in the conveying direction of the first spiral portion, a spiral direction of the second spiral portion being an opposite direction to a spiral direction of the first spiral portion, with a conveying direction of the second spiral portion being a reverse direction relative to the direction in which the developer in the circulation path in the first chamber circulates; and a disk portion provided on the rotary shaft portion upstream of the second spiral portion in the conveying direction of the second spiral portion and provided to project radially outwardly from a whole circumference of the rotary shaft portion in a position adjacent to the second spiral portion;

a second conveying member configured to convey the developer, the second conveying member being provided rotatably in the second chamber; and a discharge outlet through which surplus developer is discharged toward outside, the discharge outlet being provided at an end of the first chamber and being on a side of the conveying direction of the first spiral portion and adjacent to the disk portion in a position through which the rotary shaft portion of the first conveying member is extended, wherein the second spiral portion and the disk portion are arranged with an interval therebetween in a rotation axial direction of the rotary shaft.

2. A developing apparatus according to claim 1, wherein the interval between the disk portion and the second spiral portion is 1 mm or more and 5 mm or less.

3. A developing apparatus according to claim 1, wherein an outer diameter of an upstream end portion of the second spiral portion in the conveying direction of the second spiral portion is smaller than an outer diameter of the disk portion.

4. A developing apparatus according to claim 1, wherein a shape of a blade of the second spiral portion on a side of the disk portion is configured so that a width of the blade in the rotation axial direction of the rotary shaft portion gets smaller toward an end of the second spiral portion in the spiral direction.

5. A developing apparatus according to claim 1, wherein a maximum diameter of the second spiral portion is substantially equal to a diameter of the disk portion.

6. A developing apparatus according to claim 1, wherein a cut end surface of a blade of the second spiral portion on an upstream part of the second spiral portion in the conveying direction of the second spiral portion is formed so as to be orthogonal to the rotary shaft portion.

7. A developing apparatus according to claim 1, wherein a cut end surface of a blade of the second spiral portion on an upstream part of the second spiral portion in the conveying direction of the second spiral portion is formed so as to be parallel to the rotary shaft portion.

8. A developing apparatus, comprising:

a containing portion configured to contain developer including toner and carrier, the containing portion including a first chamber and a second chamber provided adjacent to the first chamber and communicated with the first chamber to form a circulation path through which the developer circulates;

a supplying device configured to supply the developer to the containing portion;

a first conveying member configured to convey the developer, the first conveying member being provided rotatably in the first chamber, the first conveying member comprising:

a rotatable rotary shaft portion;

a first spiral portion extending in a longitudinal direction of the first chamber in the circulation path in the first chamber and provided around the rotary shaft portion, with a conveying direction of the first spiral portion being a forward direction relative to a direction in which the developer in the circulation path in the first chamber circulates;

a second spiral portion provided on the rotary shaft portion downstream of the first spiral portion in the conveying direction of the first spiral portion, a spiral direction of the second spiral portion being an opposite direction to a spiral direction of the first spiral portion, with a conveying direction of the second spiral portion being a reverse direction relative to the direction in which the developer in the circulation path in the first chamber circulates; and a disk portion provided on the rotary shaft portion upstream of the second spiral portion in a conveying direction of the second spiral portion and provided to project radially outwardly from a whole circumference of the rotary shaft portion in a position adjacent to the second spiral portion;

a second conveying member configured to convey the developer, the second conveying member being provided rotatably in the second chamber; and a discharge outlet through which surplus developer is discharged toward outside, the discharge outlet being provided at an end of the first chamber and being on a side of the conveying direction of the first spiral portion and adjacent to the disk portion in a position through which the rotary shaft portion of the first conveying portion is extended, wherein a diameter of the second spiral portion of an upstream end portion in the conveying direction of the second spiral portion is smaller than an outer diameter of the disk portion, and wherein the second spiral portion has a larger blade diameter on a downstream side of the second spiral portion than at the most upstream end portion of the second spiral portion.

9. A developing apparatus according to claim 8, wherein a maximum diameter of the second spiral portion is substantially equal to the diameter of the disk portion.

* * * * *